US011097867B1

(12) United States Patent
Nixon et al.

(10) Patent No.: US 11,097,867 B1
(45) Date of Patent: Aug. 24, 2021

(54) METHOD AND BLANK CONFIGURATION FOR FORMING A READY TO DISPLAY TRAY

(71) Applicant: WEXXAR PACKAGING, INC., Richmond (CA)

(72) Inventors: Dyrl Nixon, Courtenay (CA); Michael Mack, Coldstream (CA)

(73) Assignee: WEXXAR PACKAGING, INC., B.C. (CA)

( * ) Notice: Subject to any disclaimer, the term of this patent is extended or adjusted under 35 U.S.C. 154(b) by 113 days.

(21) Appl. No.: 16/566,252

(22) Filed: Sep. 10, 2019

Related U.S. Application Data

(60) Provisional application No. 62/729,475, filed on Sep. 11, 2018.

(51) Int. Cl.

| | |
|---|---|
| ***B65D 5/54*** | (2006.01) |
| ***B65D 5/468*** | (2006.01) |
| ***B65D 5/42*** | (2006.01) |
| ***B65D 5/02*** | (2006.01) |

(52) U.S. Cl.
CPC ..... *B65D 5/5445* (2013.01); *B65D 5/02* (2013.01); *B65D 5/4266* (2013.01); *B65D 5/4608* (2013.01)

(58) Field of Classification Search
CPC ..... B65D 5/54; B65D 5/542; B65D 5/5445; B65D 5/02; B65D 5/4266; B65D 5/4608
USPC ..... 229/100, 235, 240, 164, 242, 103; 206/774, 746, 738, 736
See application file for complete search history.

(56) References Cited

U.S. PATENT DOCUMENTS

| | | | | |
|---|---|---|---|---|
| 4,553,666 | A | 11/1985 | Gullikson | |
| 4,860,886 | A * | 8/1989 | Northrup | B65D 5/524 206/45.29 |
| 5,582,345 | A | 12/1996 | Lankhuijzen | |
| 5,657,872 | A | 8/1997 | Leftwich | |
| 5,887,717 | A | 3/1999 | Anderson | |
| 6,168,027 | B1 | 1/2001 | Esser | |
| 6,464,131 | B1 | 10/2002 | Blazevich | |
| 6,478,159 | B1 | 11/2002 | Taylor | |
| 6,510,982 | B2 | 1/2003 | White | |
| 6,588,594 | B2 | 7/2003 | Anderson | |
| 7,370,761 | B2 | 5/2008 | Anderson | |
| 7,451,878 | B2 | 11/2008 | Rochefort | |
| 7,604,114 | B2 | 10/2009 | Gessler | |
| 8,281,981 | B2 * | 10/2012 | Foden | B65D 5/5445 229/126 |
| 8,474,688 | B2 | 7/2013 | Cameron | |
| 9,187,207 | B2 | 11/2015 | Gessler, Jr. | |
| 9,555,919 | B2 | 1/2017 | Gessler, Jr. | |
| 9,809,349 | B2 | 11/2017 | Gessler, Jr. | |
| 2003/0150747 | A1 | 8/2003 | Maus | |
| 2004/0222127 | A1 | 11/2004 | McLeod | |
| 2005/0184139 | A1 | 8/2005 | Gasior | |

(Continued)

*Primary Examiner* — Christopher R Demeree
(74) *Attorney, Agent, or Firm* — Thompson Hine LLP

(57) ABSTRACT

A blank for forming a closed box for shipping and for permitting separation of one portion of the closed box from another portion of the closed box to form a tray for displaying product is provided. The blank includes a bottom part, a back part and a top part. The blank may include three distinct tear lines. One of the tear lines is located on the back part, and two of the tear lines are located on the bottom part.

7 Claims, 9 Drawing Sheets

(56) References Cited

U.S. PATENT DOCUMENTS

| | | | | |
|---|---|---|---|---|
| 2010/0276333 | A1* | 11/2010 | Couture | B65D 5/5445<br>206/774 |
| 2017/0267399 | A1* | 9/2017 | Buscema | B31B 50/74 |
| 2020/0189788 | A1* | 6/2020 | Cline | B65D 5/54 |

* cited by examiner

METHOD AND BLANK CONFIGURATION FOR FORMING A READY TO DISPLAY TRAY

TECHNICAL FIELD

This application relates generally to a corrugated tray and, more particularly, a method and blank configuration to form a ready to display tray from a box in order to display products within the tray without the process of loading products into a separate container.

BACKGROUND

In the packaging industry, using a corrugated box to contain products is common, but normally such a box is formed with a unique function which is to contain products for transportation. If a user needs to display the products for sale, another display container is needed and extra man power required to unload the products from the box and load them into the display container, which results in additional labor time and expense.

One attempt to address this issue can be found in U.S. Pat. No. 9,555,919, which provides a ready to display tray which is formed from a container that contained the products for shipping. Once the top portion of the box is torn away, a tray with products inside is formed and ready to display. The problem of this type of container is that the corrugated blank used to form the container needs to have very complicated design and the container only has one tear line which is less strong and difficult to tear. In addition, due to the special blank design, the box forming machine also needs to be tailor made, or needs complicated adjustments, in order to allow an existing box forming machine to form such container.

It would be desirable to provide an easy to make and lower cost ready to display tray.

SUMMARY

In one aspect, a ready to display tray corrugated blank has three tear lines, making it easier to tear off the upper part of the tray. The overall design of the blank is very similar to a regular blank, and therefore the requirements for the ready to display tray forming machine are not too complicate and only some adjustments of an existing box forming machine is needed.

In another aspect, a box is provided which can perform the function as a container to contain products for transportation. When the top portion of the box is torn away, a ready to display tray is formed.

A. In a further aspect, a corrugated blank consists of three parts, which are the bottom part, the back part and the top part.

B. In one implementation of the corrugated blank of paragraph A, the bottom part consists of one main bottom wall and two minor side walls. Each minor side wall extends from one of the two opposite sides of the main bottom wall, with a bending line therebetween. The bottom part is connected with the back part by a bending line located between the main bottom wall and the back wall.

C. In one implementation of the corrugated blank of paragraph B, at the front of the main bottom wall is a main bottom flap, with a bending line dividing the main bottom wall and the main bottom flap.

D. In one implementation of the corrugated blank of paragraph B, at the front of the two minor side walls there are two minor side flaps, with a respective bending line located between each minor side wall and its minor side flap.

E. In one implementation of the corrugated blank of paragraph D, a respective tear line extends from the corner of each of the two minor side walls to the middle of the two minor side flaps.

F. In one implementation of the corrugated blank of paragraph A, the back part consists of one back wall and two back side walls, where each back side wall is linked with the back wall by a respective bending line.

G. In one implementation of the corrugated blank of paragraph F, a tear line across the middle of the back wall and across each of the two back side walls.

H. In one implementation of the corrugated blank of paragraph A, the top part consists of one main top wall and two main side walls. At the two opposite sides of the main top wall are two main side walls. The main top wall is linked with back wall by a bending line.

I. In one implementation of the corrugated blank of paragraph H, at the front of the main top wall there is a main top flap.

J. In one implementation of the corrugated blank of paragraph I, at a lateral center of the main top flap, a hole is located. The main top flap is linked with the main top wall by a bending line.

K. In one implementation of the corrugated blank of paragraph H, at the front of each of the two main side walls there is a respective main side flap. A respective bending line separates each main side walls from its main side flaps.

The details of one or more embodiments are set forth in the accompanying drawings and the description below. Other features, objects, and advantages will be apparent from the description and drawings, and from the claims.

DETAILED DESCRIPTION

Figure 1:
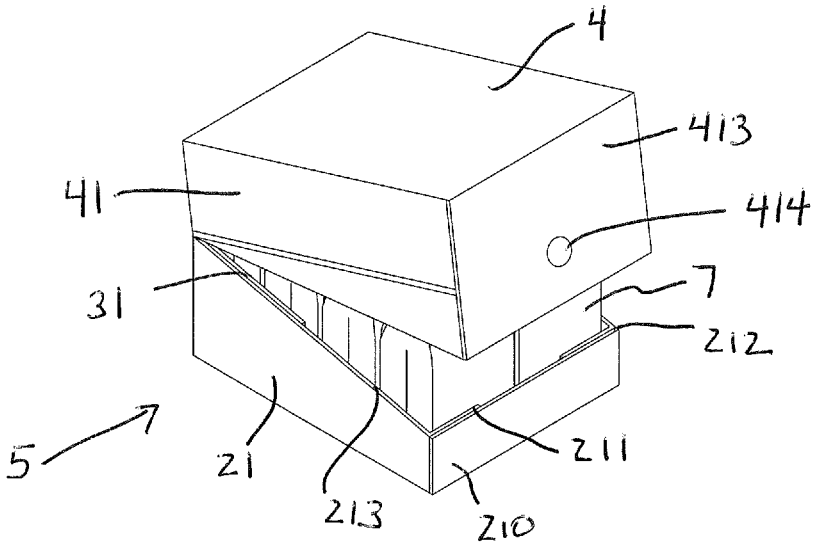
FIG. 1 is a perspective view of a box in the process of separation to form a ready to display tray for the products within the box.

FIG. 1 is the perspective view illustrating how a ready to display tray is formed from a filled box 5. The box 5 is filled with products 7 and is being torn along the tear lines 213 and 214 (not shown in FIG. 1) by gripping the upper part of the box using a hole 414 located on a main front flap 413.

Figure 2:
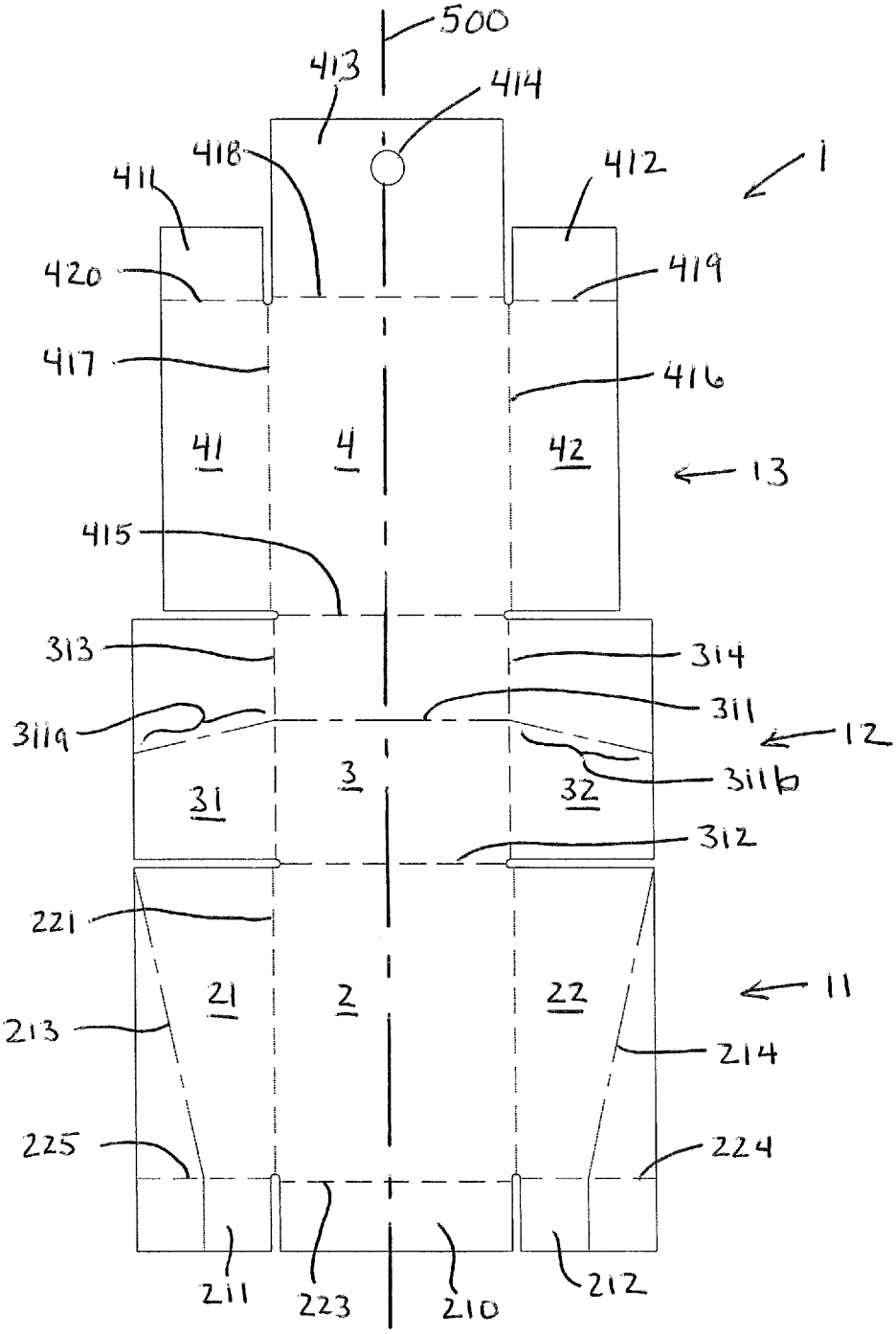
FIG. 2 is a plan view of a corrugated blank used to form the box.

FIG. 2 is a plan view of the corrugated blank 1 used to form the box 5. The corrugated blank 1 is divided into three different parts, which are the bottom part 11, the back part 12 and the top part 13. In the plan view of FIG. 2, a lengthwise axis 500 of the blank is shown. As used herein, an axial direction is a direction that is parallel to the lengthwise axis 500 and running in the plane of the blank, and a lateral direction is a direction that is perpendicular to the lengthwise axis and running in the plane of the blank. In addition, as used herein the term front when referring to sides of walls of the blank are defined relative to an orientation of the box formed once the blank is folded, with the front being the part of the box that is intended to face forward towards a customer when a display tray is formed from the box (e.g., the part of the box/tray facing to the right and slightly down on the page in the views of FIGS. 1 and 12). Therefore, folding lines 223, 224 and 225 are considered to be located at the front of the main bottom wall 2, minor side wall 22 and minor side wall 21 respectively, and folding lines 418, 411 and 419 are considered to be located at the front of the main top wall 4, main side wall 41 and main side wall 42 respectively.

The bottom part 11 includes the main bottom wall 2 and two minor side walls 21 and 22. At the front of the main bottom wall 2 is a main bottom flap 210, with a bending or fold line 223 dividing the main bottom wall 2 and main bottom flap 210. The two minor side walls 21, 22 extend from the opposite two lateral sides of the main bottom wall 2, with the bending lines 221 and 222 demarcating the opposite lateral sides of the main bottom wall. At the front of the minor side walls 21 and 22 are two minor side flaps 211, 212, with bend lines 225 and 224 dividing each minor side wall 21 and 22 from its respective minor side flap 211, 212. Each minor side wall 21 and 22 includes a respective tear line 213 and 214. Each tear line 213, 214 begins at the rear outside corner of its minor side wall 21, 22 and extends along its minor side wall 21, 22 in a direction that includes both axially forward component and a laterally inward component. Each tear line 213, 214 then continues onto the adjacent minor side flap 211, 212 in a direction substantially parallel to the axis 500.

The back part 12 includes a back wall 3 and two back side walls 31 and 32. At the two opposite sides of the back wall 3 a respective bending line 313 and 314 provides the connection of each back side wall 31 and 32 to the back wall 3. A tear line 311 extends across the back wall 3 and across each of the back side walls 31, 32. The bottom part 11 is linked with the back part 12 by a connection between the main bottom wall 2 and the back wall 3 formed by a bending line 312. The central, main portion of the tear line 311 on the back wall 3 runs substantially perpendicular to the axis 500, and the end parts 311*a*, 311*b* of the tear line extend both laterally outwardly from the back wall and slightly downward.

The top part 13 includes a main top wall 4, two main side walls 41, 42 and one main top flap 413. The two main side walls 41 and 42 are located at the two opposite sides of the main top wall 4. At the front of each main side wall 41 and 42 is a respective main side flap 411, 412, with bending lines 420 and 419 demarcating the main side walls 41, 42 from the main side flaps 411 and 412. The main top flap 413 connects to the front of the main top wall 4, via bending line 418. The main top flap 413 has a hole 414 at its lateral center. The main top wall 4 of the top part 13 is linked with the back part 12 through the back wall 3 by a bending line 415 between the two walls.

Figure 3:
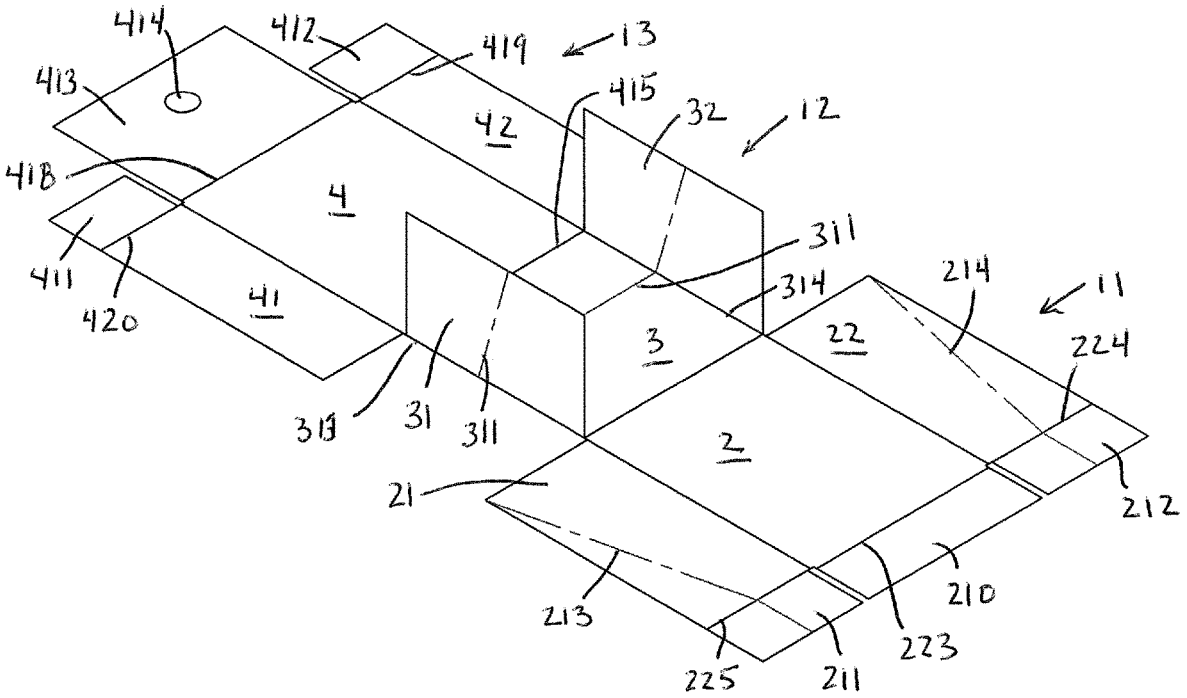
FIGS. 3-5 are perspective views of box formation from the corrugated blank.
Figure 4:
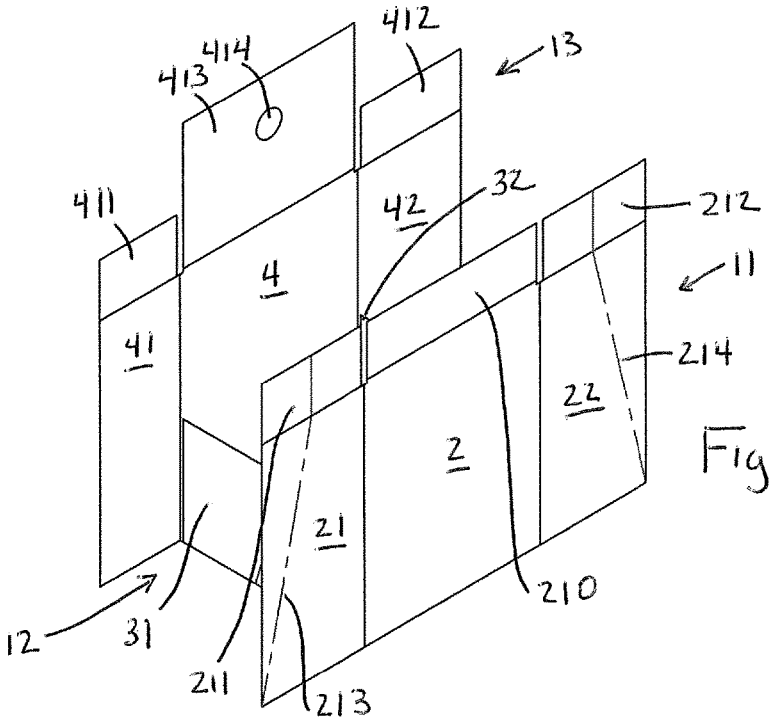
Figure 5:
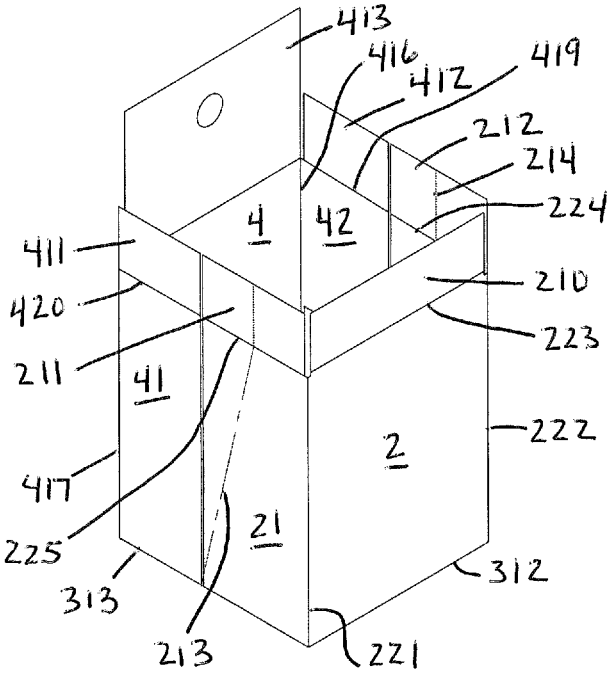

FIGS. 3-5 depict the manner in which the blank 1 is folded in order to form a box into condition to be loaded. Notably, the front of the box is facing upward in the FIG. 5 orientation. In FIG. 3, the box 5 forming process starts by bending along the bending lines 313 and 314 located between back wall 3 and back side walls 31, 32 in order to move the back side walls 31 and 32 to an upright orientation. In FIG. 4, both the main top wall 4 and main bottom wall 2 are moved to stand up or upright positions relative to the back wall 3 by bending along the bending lines 312 and 415. In FIG. 5, the minor side wall 21 and main side wall 41 are moved towards and alongside the back side wall 31 (e.g., parallel to the back side wall 31) by bending along the bending lines 221 and 417. At the other side, the minor side wall 22 and main side wall 42 are also moved toward and alongside the back side wall 32 by bending along the bending lines 222 and 416 (not shown in FIG. 5). In the FIG. 5 condition, the box 5 could be considered partially formed because the box is not yet closed, with the front of the box open and facing upward for loading product into the box.

Figure 6:
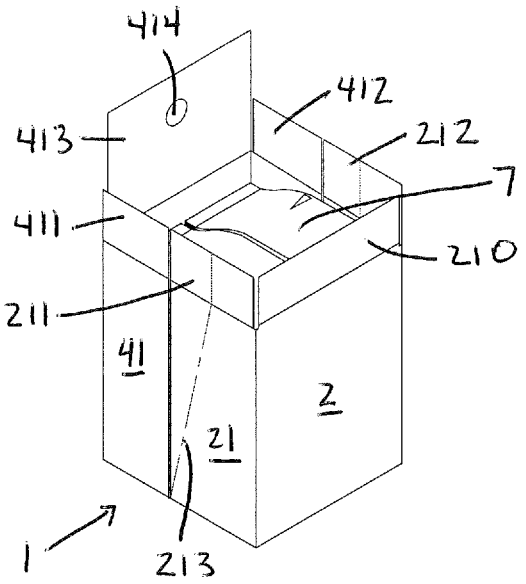
FIGS. 6-8 are perspective views showing product placement within the box and box closure.
Figure 7:
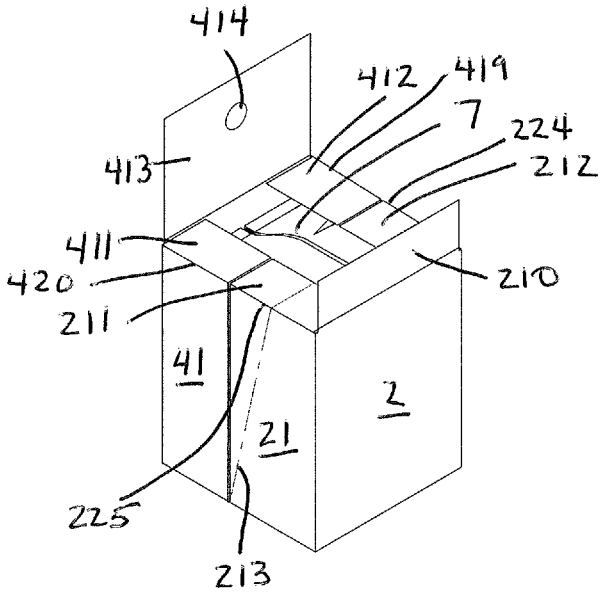
Figure 8:
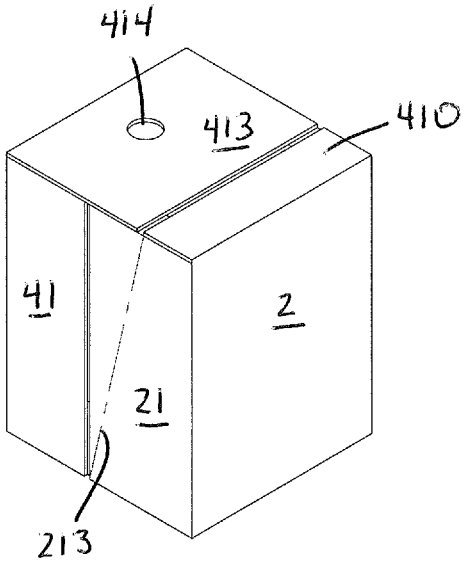

FIGS. 6-8 depict filling the box 5 with products 7 and final formation of the box 5 to closed condition for shipping. In FIG. 6, the products 7 are placed into the end opening of the partially formed box 5. Referring to FIG. 7, after the products 7 are put into the partially formed box 5, the main side flap 411 and the minor side flap 211 are moved by bending along the respective bending lines 420 and 225. At the same time, the main side flap 412 and the minor side minor side flap 212 also moved by bending along the respective bending lines 419 and 224. In this condition the flaps 411, 211 and 412, 212 partially close the end opening of the box. In FIG. 8, the main bottom flap 210 and the main top flap 413 are moved by bending along respective bending lines 418 and 223 to fully cover the end opening and closed the box 5. The main bottom flap 210 may, for example, be secured in the closed condition by adhesive that attaches the internal side of the main bottom flap to the external side of the minor side flaps 211 and 212. Likewise, the main tip flap 413 may, for example, be secured to the closed condition by adhesive that attached the internal side of the main top flap to both the main side flaps 411 and 412 and the minor side flaps 211 and 212.

Figure 9:
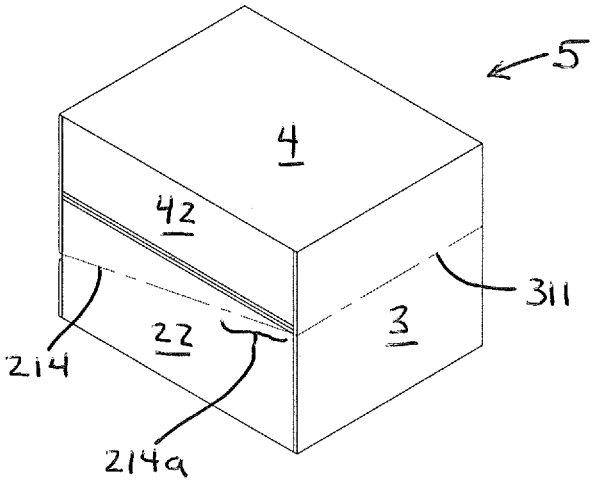
FIG. 9 is a back view of the closed box.

FIG. 9 is the back view of the loaded and closed box 5. The tear lines 213 (not shown in FIG. 9), 214 and 311 extend along minor side wall 22, across back wall 3 to along minor side wall 21 (not shown in FIG. 9). The end parts of tear line 311 (i.e., the parts 311*a* and 311*b* of tear line 311 located on back side walls 31 and 32 per FIG. 2) overlap and align with the end parts of the tear lines 213 and 214 (e.g., per end part 214*a* in FIG. 9).

Figure 10:
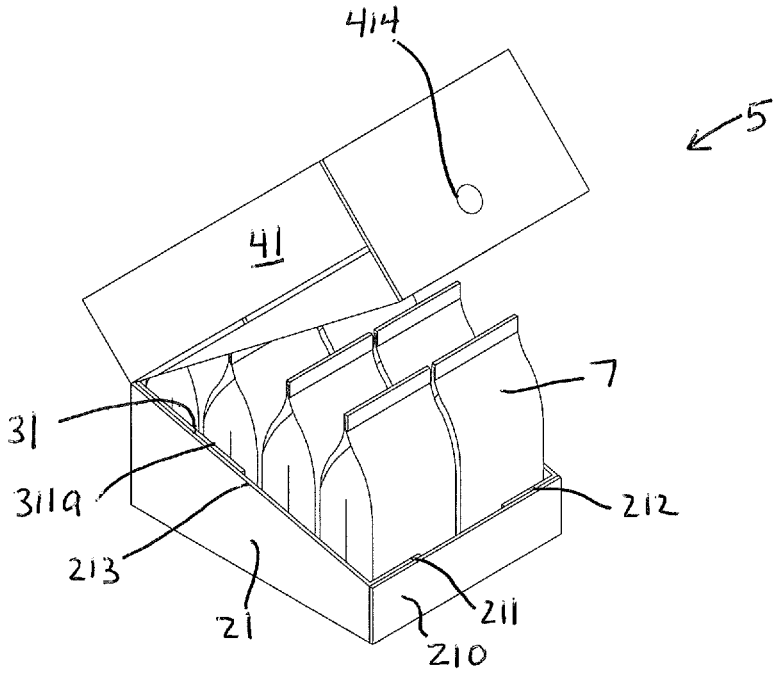
FIGS. 10-12 are perspective views showing formation of a ready to display tray by separation of an upper part of the box.
Figure 11:
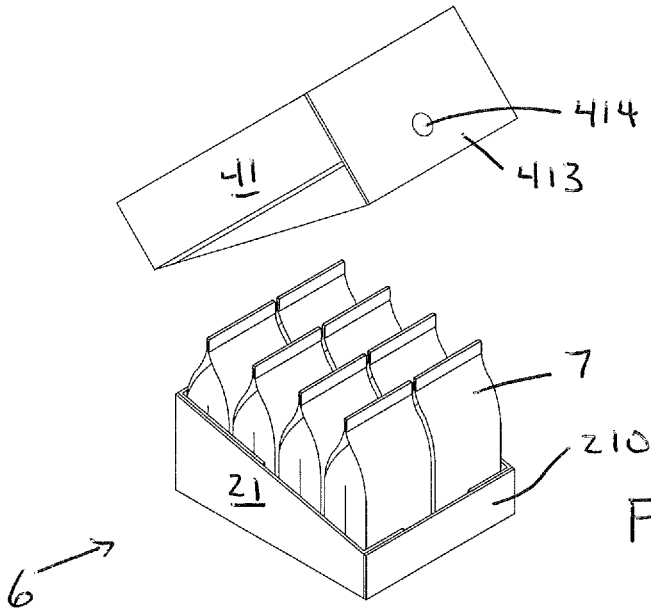
Figure 12:
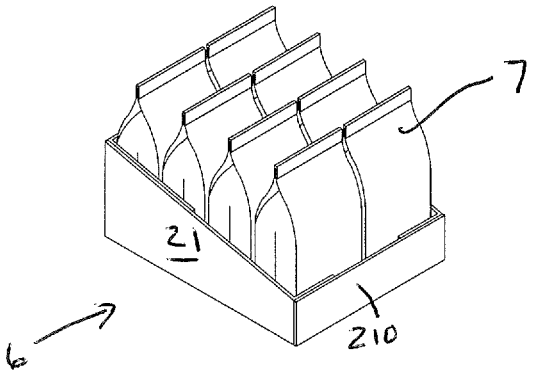

Referring to FIG. 10, the box 5 is torn open along the tear lines 213 and 214 and the end parts 311*a* and 311*b* of the tear line 311. A user inserts a finger into the hole 414 located on the main top flap 413 and applies an upward pulling force which causes the separation along the tear lines 213 and 214 and tear line end parts 311*a* and 311*b* as the top of the box is pulled and pivoted upward to open. In FIG. 11, the box 5 is completely torn open by applying further pulling force that causes final separation along the middle portion of the tear line 311 (not shown). In FIG. 12 a ready to display tray 6 is formed with products 7 already sitting inside.

Figure 13:
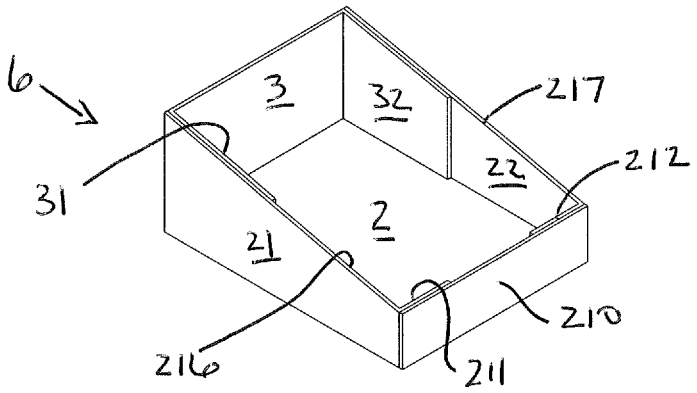
FIG. 13 is a perspective view of the ready to display tray without product therein.

FIG. 13 is a perspective view of the ready to display tray 6 in empty condition. Notably, part of each minor side wall 21 and 22 has been torn away and part of each back side wall 31 and 32 has been torn away to form sloped edges 216 and 217.

As used herein the term bending line is intended to refer to a structural feature of the blank (e.g., typically creasing or minor scoring). As used herein the term tear line is intended to refer to a structural feature of the blank that is more significant than a bending line, to facilitate tearing (e.g., significant scoring or significant through perforating).

Each of the walls and flaps of the blank (i.e., 2, 210, 21, 211, 22, 212, 3, 31, 32, 4, 41, 42, 411, 412, 413) may be referred to as a panel part, such that the blank has nine wall panel parts and six flap panel parts.

AA. Thus a unique and desirable blank is provided for forming a closed box for shipping and for permitting separation of one portion of the closed box from another portion of the closed box to form a tray for displaying product, the blank comprising: a bottom part (11), a back part (12) and a top part (13); wherein the bottom part includes a main bottom wall (2), a first minor side wall (21) and a second minor side wall (22), the first minor side wall joined to a first lateral side of the main bottom wall by a first axial bending line (221), the second minor side wall joined to a second lateral side of the main bottom wall by a second axial bending line (222), a front side the main bottom wall joined to a main bottom flap (210) by a first lateral bending line (223), a front side of the first minor side wall joined to a first minor side flap (211) by a second lateral bending line (225), a front side of the second minor side wall joined to a second minor side flap (212) by a third lateral bending line (224), a first tear line (213) extending along the first minor side wall and onto the first minor side flap, a second tear line (214) extending along the second minor side wall and onto the second minor side flap, wherein the first tear line extends transverse to both axial and lateral directions on the first minor side wall and extends axially along the first minor side flap, wherein the second tear line extends transverse to both axial and lateral directions on the second minor side wall and extends axially along the second minor side flap; wherein the back part includes a back wall (3), a first back side wall (31) and a second back side wall (32), the back wall joined to the main bottom wall by a fourth lateral bending line (312), the first back side wall joined to a first lateral side of the back wall by a third axial bending line (313), the second back side wall joined to a second lateral side of the back wall by a fourth axial bending line (314), a third tear line (311) extending across the back wall and across each of the first back side wall and the second back side wall, wherein the third tear line extends laterally across the back wall and extends transverse to both axial and lateral directions on each of the first back side wall and the second back side wall; wherein the top part includes a main top wall (4), a first main side wall (41) and a second main side wall (42), the main top wall joined to the back wall by a fifth lateral bending line (415), the first main side wall joined to a first lateral side of the main top wall by a fifth axial bending line (417), the second main side wall joined to a second lateral side of the main top wall by a sixth axial bending line (416), a front side the main top wall joined to a main top flap (413) by a sixth lateral bending line (418), a front side of the first main side wall joined to a first main side flap (411) by a seventh lateral bending line (418), a front side of the second main side wall joined to a second main side flap (412) by an eighth lateral bending line (419).

BB. Also provided is a blank for forming a closed box for shipping and for permitting separation of one portion of the closed box from another portion of the closed box to form a tray for displaying product, the blank comprising: a bottom part (11), a back part (12) and a top part (13); wherein the bottom part includes a main bottom wall (2), a first minor side wall (21) and a second minor side wall (22), the first minor side wall joined to a first lateral side of the main bottom wall, the second minor side wall joined to a second lateral side of the main bottom wall, a front side the main bottom wall joined to a main bottom flap, a front side of the first minor side wall joined to a first minor side flap, a front side of the second minor side wall joined to a second minor side flap, a first tear line (213) extending along the first minor side wall and onto the first minor side flap, a second tear line (214) extending along the second minor side wall and onto the second minor side flap; wherein the back part includes a back wall (3), a first back side wall (31) and a second back side wall (32), the back wall joined to the main bottom wall, the first back side wall joined to a first lateral side of the back wall, the second back side wall joined to a second lateral side of the back wall, a third tear line (311) extending across the back wall and across each of the first back side wall and the second back side wall; wherein the top part includes a main top wall (4), a first main side wall (41) and a second main side wall (42), the main top wall joined to the back wall, the first main side wall joined to a first lateral side of the main top wall, the second main side wall joined to a second lateral side of the main top wall, a front side the main top wall joined to a main top flap (413), a front side of the first main side wall joined to a first main side flap, a front side of the second main side wall joined to a second main side flap (412).

CC. Also provided is a substantially planar blank for forming a closed box for shipping and for permitting separation of one portion of the closed box from another portion of the closed box to form a tray for displaying product, the blank comprising: fifteen panel parts, including nine wall panels that form bottom, back, top, left and right sides of a closed box, and six flap panels that form a front of the closed box; wherein a first tear (213) line extends along a first minor side wall panel (21) and onto a first minor side flap panel (211), a second tear line (214) extends along a second minor side wall panel (22) and onto a second minor side flap panel (212), wherein the first tear line extends transverse to both axial and lateral directions on the first minor side wall panel and extends axially along the first minor side flap panel, wherein the second tear line extends transverse to both axial and lateral directions on the second minor side wall panel and extends axially along the second minor side flap panel.

DD. The blank of above paragraph CC, wherein a third tear line (311) extends across a back wall panel (3) and across each of a first back side wall panel (31) and a second back side wall panel (32), wherein the third tear line extends laterally across the back wall panel and extends transverse to both axial and lateral directions on each of the first back side wall panel and the second back side wall panel.

EE. In the blank of above paragraph DD, wherein the third tear (311) line angles toward the first minor side wall panel (21) as the third tear line moves outward along the first back side wall panel (31), and the third tear line angles toward the second minor side wall panel (22) as the third tear line moves outward along the second back side wall panel (32).

It is to be clearly understood that the above description is intended by way of illustration and example only, is not intended to be taken by way of limitation, and that other changes and modifications are possible.

What is claimed is:

1. A blank for forming a closed box for shipping and for permitting separation of one portion of the closed box from another portion of the closed box to form a tray for displaying product, the blank comprising:

a bottom part, a back part and a top part;

wherein the bottom part includes a main bottom wall, a first minor side wall and a second minor side wall, the first minor side wall joined to a first lateral side of the main bottom wall by a first axial bending line, the second minor side wall joined to a second lateral side of the main bottom wall by a second axial bending line, a front side of the main bottom wall joined to a main bottom flap by a first lateral bending line, a front side of the first minor side wall joined to a first minor side flap by a second lateral bending line, a front side of the second minor side wall joined to a second minor side flap by a third lateral bending line, a first tear line extending along the first minor side wall and onto the first minor side flap, a second tear line extending along the second minor side wall and onto the second minor side flap, wherein the first tear line extends transverse to both axial and lateral directions on the first minor side wall and extends axially along the first minor side flap, wherein the second tear line extends transverse to both axial and lateral directions on the second minor side wall and extends axially along the second minor side flap;

wherein the back part includes a back wall, a first back side wall and a second back side wall, the back wall joined to the main bottom wall by a fourth lateral bending line, the first back side wall joined to a first lateral side of the back wall by a third axial bending line, the second back side wall joined to a second lateral side of the back wall by a fourth axial bending line, a third tear line extending across the back wall and across each of the first back side wall and the second back side wall, wherein the third tear line extends laterally across the back wall and extends transverse to both axial and lateral directions on each of the first back side wall and the second back side wall;

wherein the top part includes a main top wall, a first main side wall and a second main side wall, the main top wall joined to the back wall by a fifth lateral bending line, the first main side wall joined to a first lateral side of the main top wall by a fifth axial bending line, the second main side wall joined to a second lateral side of the main top wall by a sixth axial bending line, a front side of the main top wall joined to a main top flap by a sixth lateral bending line, a front side of the first main side wall joined to a first main side flap by a seventh lateral bending line, a front side of the second main side wall joined to a second main side flap by an eighth lateral bending line.

2. A blank for forming a closed box for shipping and for permitting separation of one portion of the closed box from another portion of the closed box to form a tray for displaying product, the blank comprising:

a bottom part, a back part and a top part;

wherein the bottom part includes a main bottom wall, a first minor side wall and a second minor side wall, the first minor side wall joined to a first lateral side of the main bottom wall, the second minor side wall joined to a second lateral side of the main bottom wall, a front side of the main bottom wall joined to a main bottom flap, a front side of the first minor side wall joined to a first minor side flap that is positioned alongside the main bottom flap, a front side of the second minor side wall joined to a second minor side flap that is positioned alongside the main bottom flap, a first tear line extending along the first minor side wall and onto the first minor side flap, a second tear line extending along the second minor side wall and onto the second minor side flap;

wherein the back part includes a back wall, a first back side wall and a second back side wall, the back wall joined to the main bottom wall, the first back side wall joined to a first lateral side of the back wall, the second back side wall joined to a second lateral side of the back wall, a third tear line extending across the back wall and across each of the first back side wall and the second back side wall;

wherein the top part includes a main top wall, a first main side wall and a second main side wall, the main top wall joined to the back wall, the first main side wall joined to a first lateral side of the main top wall, the second main side wall joined to a second lateral side of the main top wall, a front side of the main top wall joined to a main top flap, a front side of the first main side wall joined to a first main side flap, a front side of the second main side wall joined to a second main side flap.

3. The blank of claim 2, wherein the front side of the first main side wall is joined to the first main side flap by a bend line that directly connects the front side of the first main side wall to the first main side flap, wherein the front side of the second main side wall is joined to the second main side flap by a bend line that directly connects the front side of the second main side wall to the second main side flap.

4. A substantially planar blank for forming a closed box for shipping and for permitting separation of one portion of the closed box from another portion of the closed box to form a tray for displaying product, the blank comprising:

fifteen panel parts, including nine wall panels that form bottom, back, top, left and right sides of a closed box, and six flap panels that form a front of the closed box;

wherein a first tear line extends along a first minor side wall panel and onto a first minor side flap panel, a second tear line extends along a second minor side wall panel and onto a second minor side flap panel, wherein the first tear line extends a full axial length of the first minor side wall and extends transverse to both axial and lateral directions on the first minor side wall panel and extends axially along the first minor side flap panel, wherein the second tear line extends a full axial length of the second minor side wall and extends transverse to both axial and lateral directions on the second minor side wall panel and extends axially along the second minor side flap panel.

5. The blank of claim 4 wherein a third tear line extends across a back wall panel and across each of a first back side wall panel and a second back side wall panel, wherein the third tear line extends laterally across the back wall panel and extends transverse to both axial and lateral directions on each of the first back side wall panel and the second back side wall panel.

6. The blank of claim 5 wherein the third tear line angles toward the first minor side wall panel as the third tear line moves outward along the first back side wall panel, and the third tear line angles toward the second minor side wall panel as the third tear line moves outward along the second back side wall panel.

7. The blank of claim 5, wherein the third tear line extends linearly across the back wall panel and perpendicular to an axial length of the back wall panel.

* * * * *